US006543641B2

(12) United States Patent
Hubanks et al.

(10) Patent No.: US 6,543,641 B2
(45) Date of Patent: Apr. 8, 2003

(54) FOLDED PAPER TOWEL DISPENSER

(75) Inventors: Brian D. Hubanks, Dousman, WI (US); Paul A. Omdoll, Waukesha, WI (US)

(73) Assignee: The Coleman Group, Elkhorn, WI (US)

( * ) Notice: Subject to any disclaimer, the term of this patent is extended or adjusted under 35 U.S.C. 154(b) by 6 days.

(21) Appl. No.: 09/748,521

(22) Filed: Dec. 22, 2000

(65) Prior Publication Data

US 2001/0020624 A1 Sep. 13, 2001

Related U.S. Application Data

(63) Continuation-in-part of application No. 09/392,187, filed on Sep. 9, 1999, now Pat. No. 6,315,155.

(51) Int. Cl.[7] ..... A47K 10/24; B65H 1/00

(52) U.S. Cl. ..... 221/45; 221/34; 221/44; 221/63

(58) Field of Search ..... 221/34, 36, 38, 221/44, 45, 55, 61, 63, 283, 287

(56) References Cited

U.S. PATENT DOCUMENTS

| | | | | |
|---|---|---|---|---|
| 2,830,728 A | | 4/1958 | Krueger et al. | |
| 4,623,074 A | | 11/1986 | Dearwester | |
| 4,678,099 A | | 7/1987 | Matsui | |
| 4,938,382 A | | 7/1990 | Frazier et al. | |
| 5,074,430 A | | 12/1991 | Roberts | |
| 5,090,592 A | | 2/1992 | Petterson et al. | |
| 5,102,007 A | * | 4/1992 | Petterson et al. | 221/33 |
| 5,950,863 A | | 9/1999 | Schutz et al. | |
| 6,003,723 A | | 12/1999 | Morand | |
| 6,230,929 B1 | * | 5/2001 | Phelps et al. | 221/46 |
| 6,286,713 B1 | * | 9/2001 | Chan et al. | 221/33 |
| 6,315,155 B1 | * | 11/2001 | Hubanks et al. | 221/38 |

* cited by examiner

*Primary Examiner*—Christopher P. Ellis
*Assistant Examiner*—Gene O Crawford
(74) *Attorney, Agent, or Firm*—Michael Best & Friedrich LLP

(57) ABSTRACT

The device for dispensing paper towels has a housing for holding a generally vertical stack of the paper towels and including a lower portion through which individual towels can be dispensed. The lower portion includes an elongated opening through which a fold of the bottommost towel can extend and be accessible for a user to grab and pull the bottommost towel from the stack. Improved towel dispensing is enabled by laterally spaced and upwardly-directed ramps located in the vicinity of the front edge of the opening and upon which an edge of the stack rests, opposed end pads angled downwardly to the opening and upon which the stack ends rest, and/or a bottom cabinet portion angled with respect to the rest of the cabinet to transfer stack weight. The opening preferably is shaped to cause the fold of the bottommost towel to assume a C-shape.

30 Claims, 6 Drawing Sheets

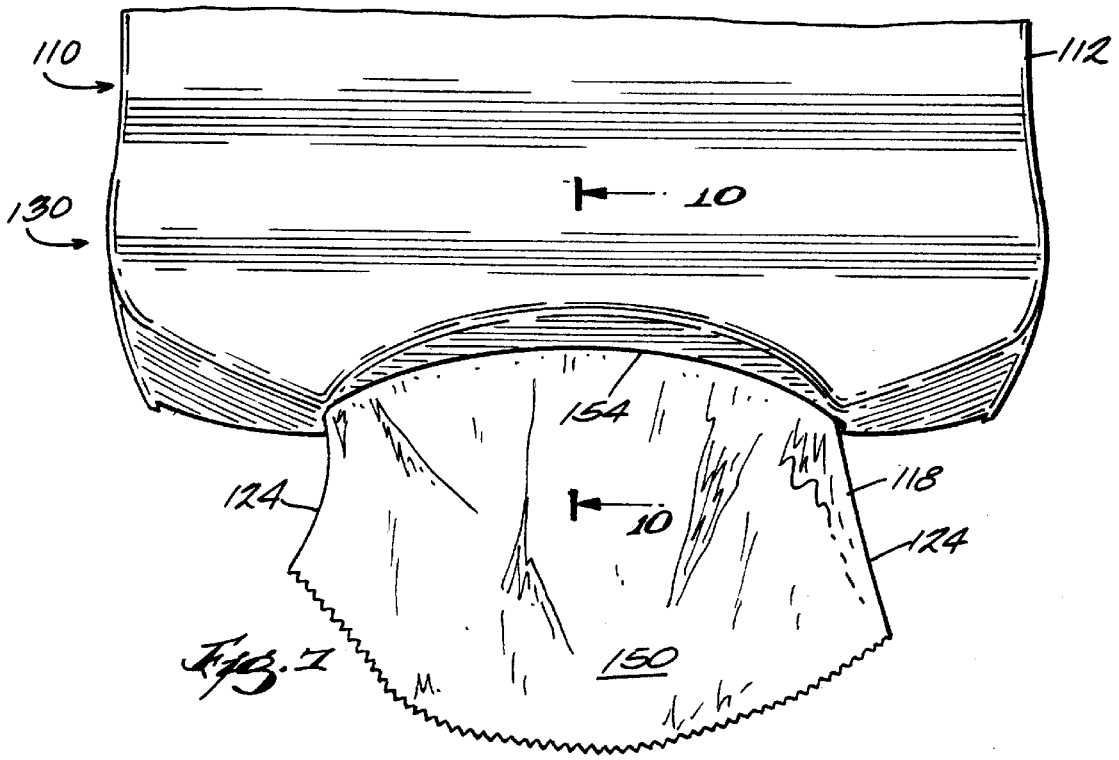
Fig. 7
Fig. 8
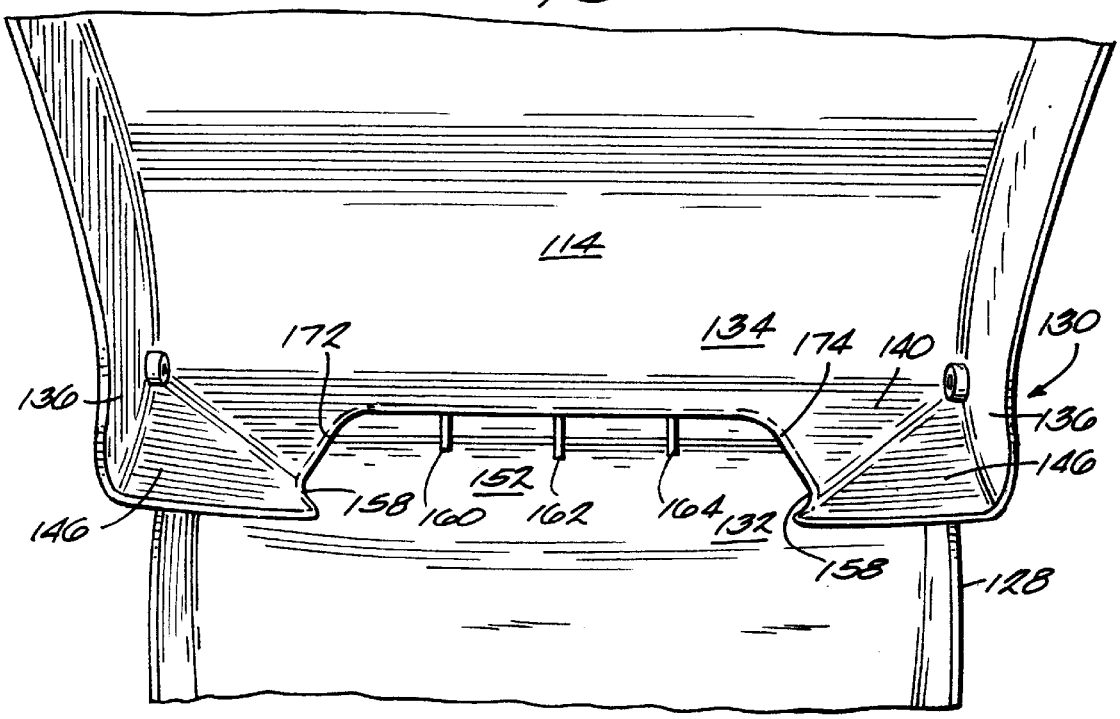

FOLDED PAPER TOWEL DISPENSER

RELATED APPLICATIONS

This application is a continuation-in-part of U.S. patent application Ser. No. 09/392,187, filed on Sep. 9, 1999 and issued on Nov. 13, 2001 as U.S. Pat. No. 6,315,155.

The device for dispensing multi-fold paper towels provided by the invention includes a housing for holding a generally vertical stack of the paper towels and a lower portion through which individual towels are dispensed from the stack. The lower portion preferably includes a front wall, rear wall, opposed side walls and a bottom wall. The paper towels are dispensed through an elongated opening in the bottom wall through which a fold of the bottommost towel in the stack can extend and be disposed in a position where a user can grab the fold and pull the bottommost towel from the stack. The present invention provides one or more elements for improved towel dispensing. Specifically, the device can include a plurality of laterally spaced ramps or ribs located in the vicinity of one edge of the opening. These ribs have an inclined surface extending upwardly and preferably at an angle from that edge and are adapted to be engaged by and support one side portion of the towels with the other side portion supported adjacent to an opposite wall of the bottom portion. These ribs transfer a portion of the pressure applied on the bottommost towel from the side portion supported on the ribs toward the other side portion, thereby reducing the force required to pull the bottommost towel from the stack. The present invention can also or instead employ ribs arranged at a varying angle along the stack of towels. Some preferred embodiments of the present invention employ pads located on either end of the opening to transfer a portion of the pressure applied on the bottommost towel from the end portions supported on the pads toward the opening, thereby reducing the force required to pull the bottommost towel from the stack. The lower portion of the device or internal walls therein can also or instead be angled, bent, curved, or otherwise misaligned with respect to the remainder of the device in order to shift the stack weight to the rear of the cabinet, thereby resulting in desirable force distribution for towel dispense. The various embodiments of the present invention employ one or more of the above-described features and elements for significantly improved product dispensing characteristics.

In some highly preferred embodiments of the present invention, further advantages result from one edge of the opening preferably being generally U-shaped and the other edge preferably being configured to cause the fold of the towel extending through the opening to assume a C-like shape.

BRIEF DESCRIPTION OF THE DRAWINGS

FIG. 7 is a partial elevation front view of an alternate embodiment of the multi-fold paper towel dispenser illustrated in FIG. 1.

FIG. 8 is a partial elevation front view of the embodiment illustrated in FIG. 7, with the cover open to show the interior.

Figure 1:
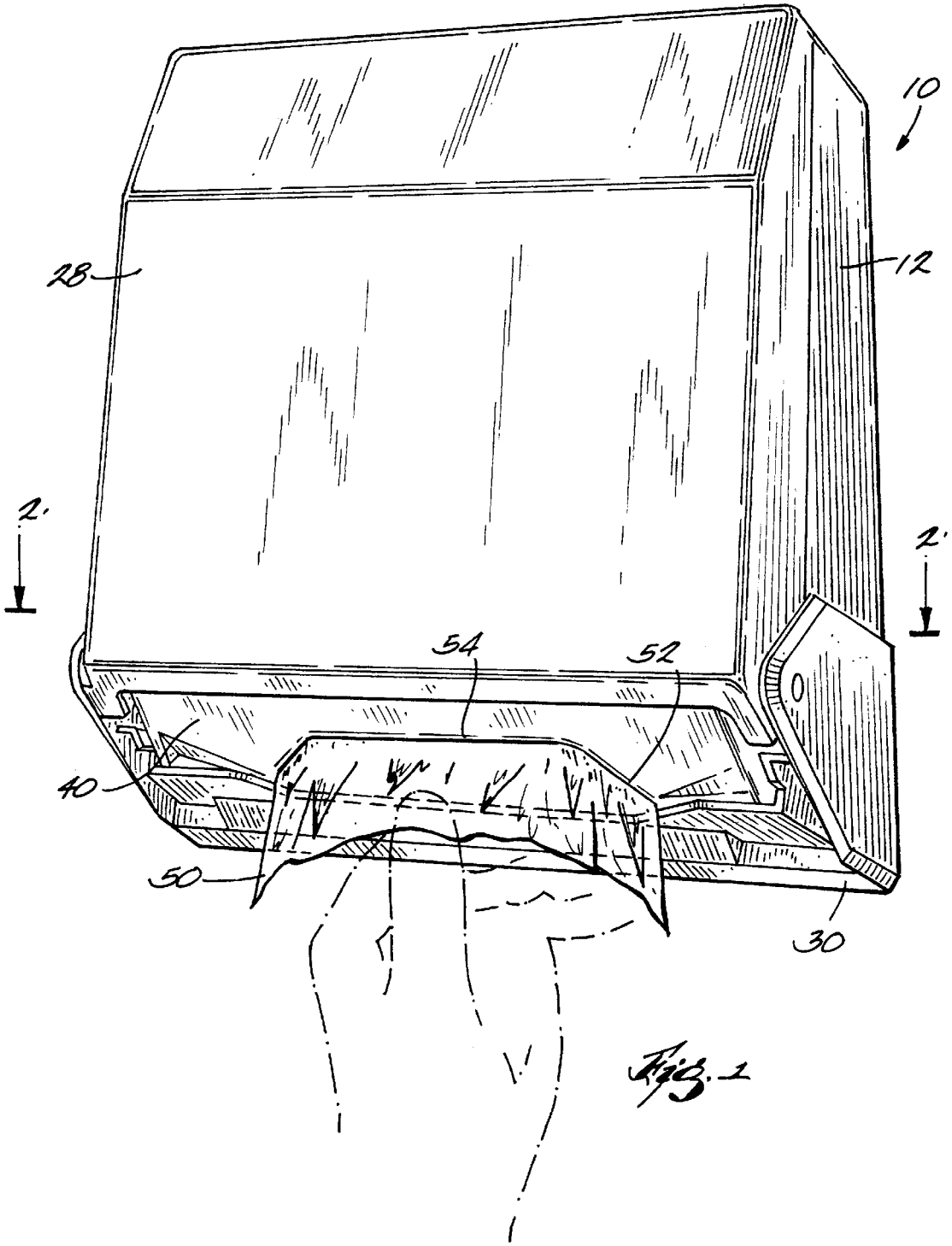
FIG. 1 is a perspective view of a multi-fold paper towel dispenser incorporating various features of the invention.

Before the illustrative embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DESCRIPTION OF PREFERRED EMBODIMENTS

FIGS. 1–6 illustrate a dispenser 10 for multi-fold paper towels incorporating various features of the invention. The dispenser 10 includes a housing or cabinet 12 having an internal chamber 14 for holding a generally vertically oriented stack 16 of elongated, generally rectangular multi-fold paper towels 18 having opposed side portions 20 and 22 and opposed end portions 24. The multi-fold paper towels 18 can be Z-fold paper towels in which succeeding towels are interfolded, C-fold paper towels in which succeeding towels are merely stacked, or any other suitable type of towel folded and/or interfolded in any conventional manner. The cabinet 12 preferably has a pivotally mounted front door 28 which can be swung down to gain access to the chamber 14 and a lower portion 30 from which individual paper towels can be dispensed from the stack. In alternate embodiments, the cabinet 12 may be formed without a front door 28. For example, access to the interior of the cabinet 12 (e.g., for placing new towels therein) can be through an open cabinet top, in which case the cabinet 12 acts much like a chute within which-stacked towels are retained prior to dispense. As another example, the cabinet 12 can have a side door or a top door hinged, detachable, or otherwise movable in any conventional manner for access to the interior of the cabinet 12.

Figure 2:
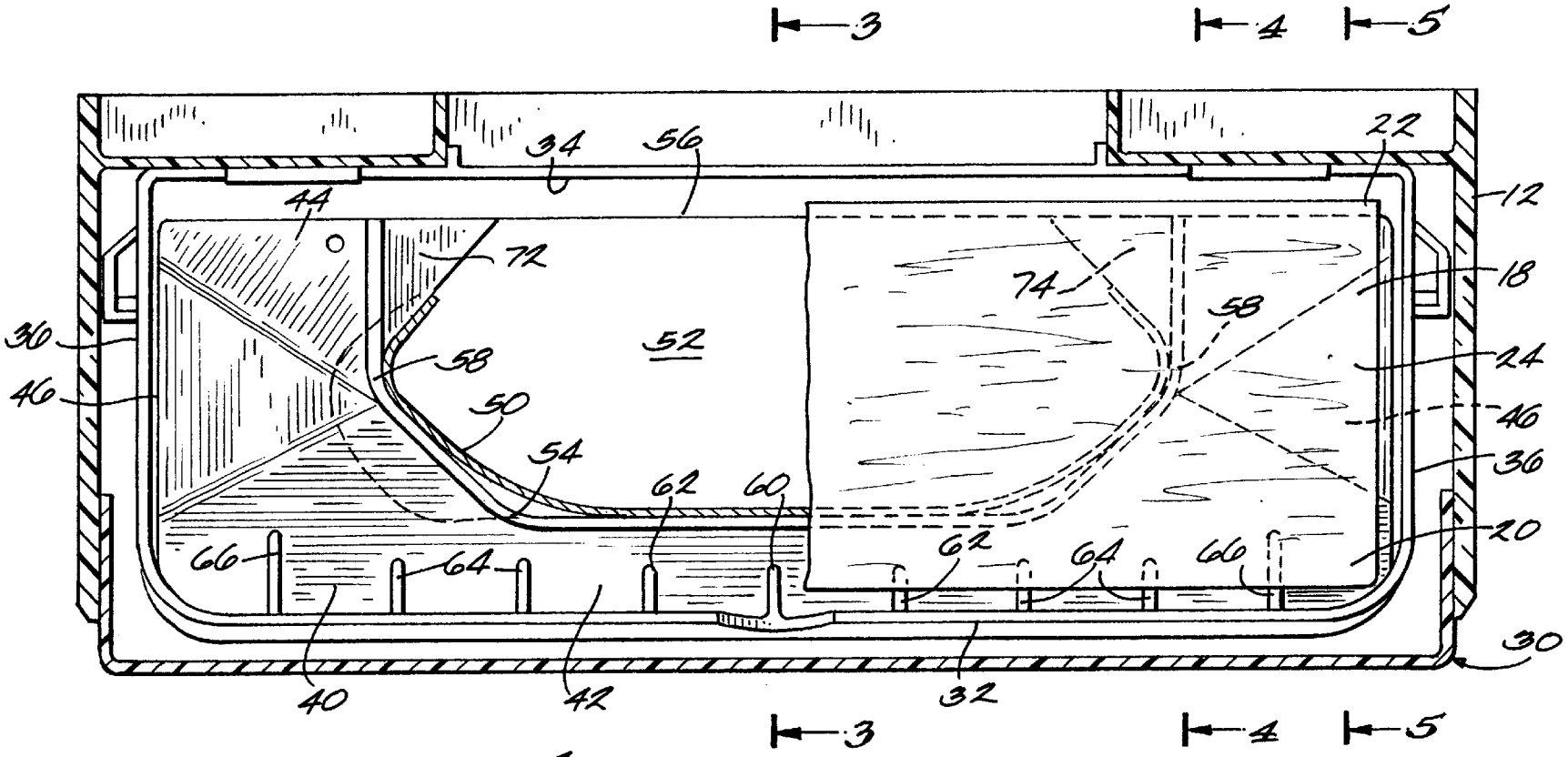
FIG. 2 is a plan sectional view taken generally along line 2—2 in FIG. 1 with a portion of the paper towels broken away to clarify the illustration of the bottom portion of the dispenser.
Figure 3:
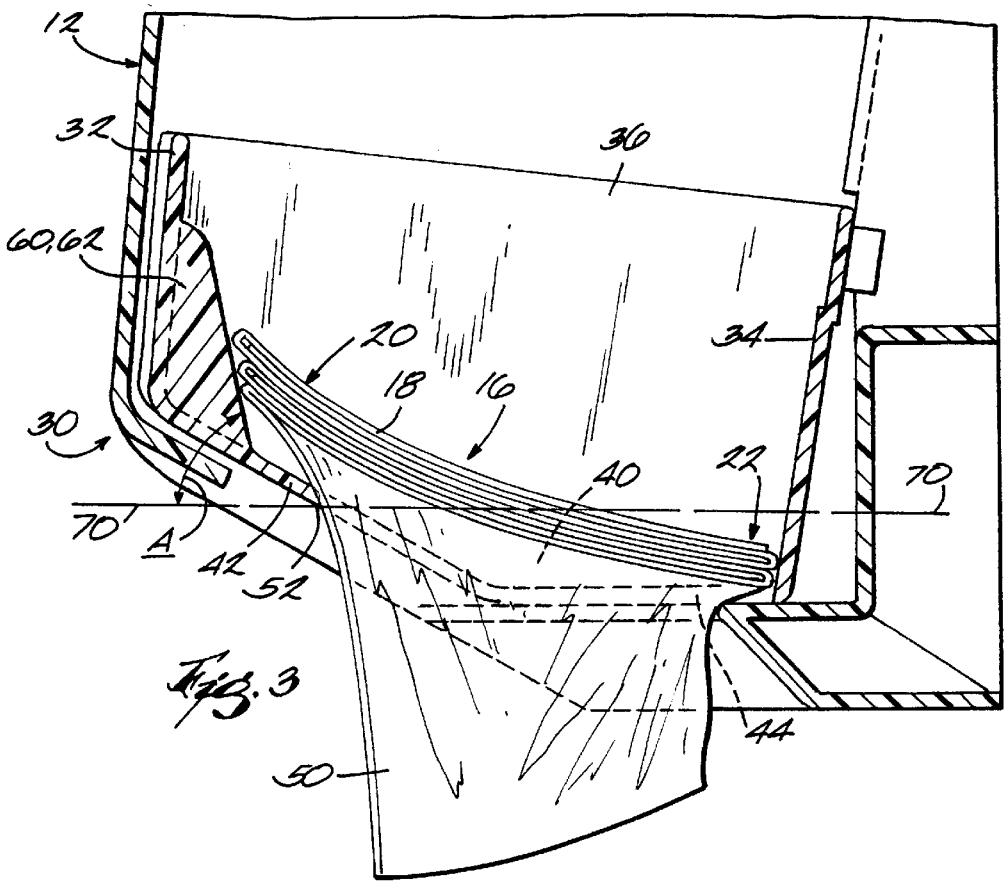
FIG. 3 is a fragmentary cross sectional view taken generally along line 3—3 in FIG. 2.
Figure 4:
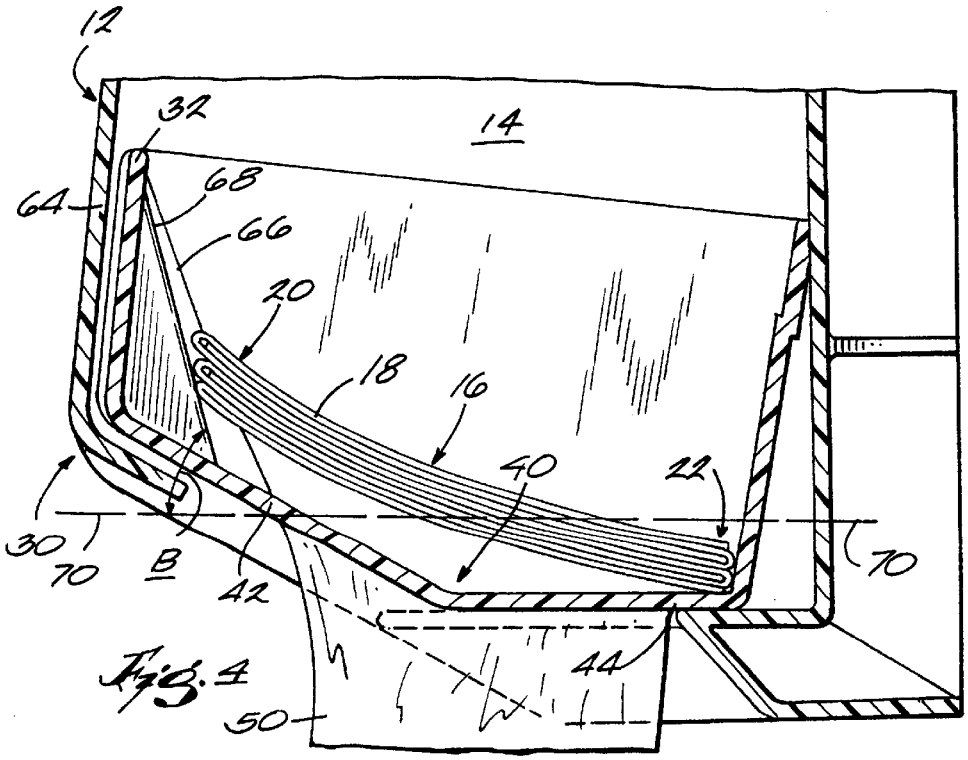
FIG. 4 is a fragmentary cross sectional view taken generally along line 4—4 in FIG. 2.
Figure 5:
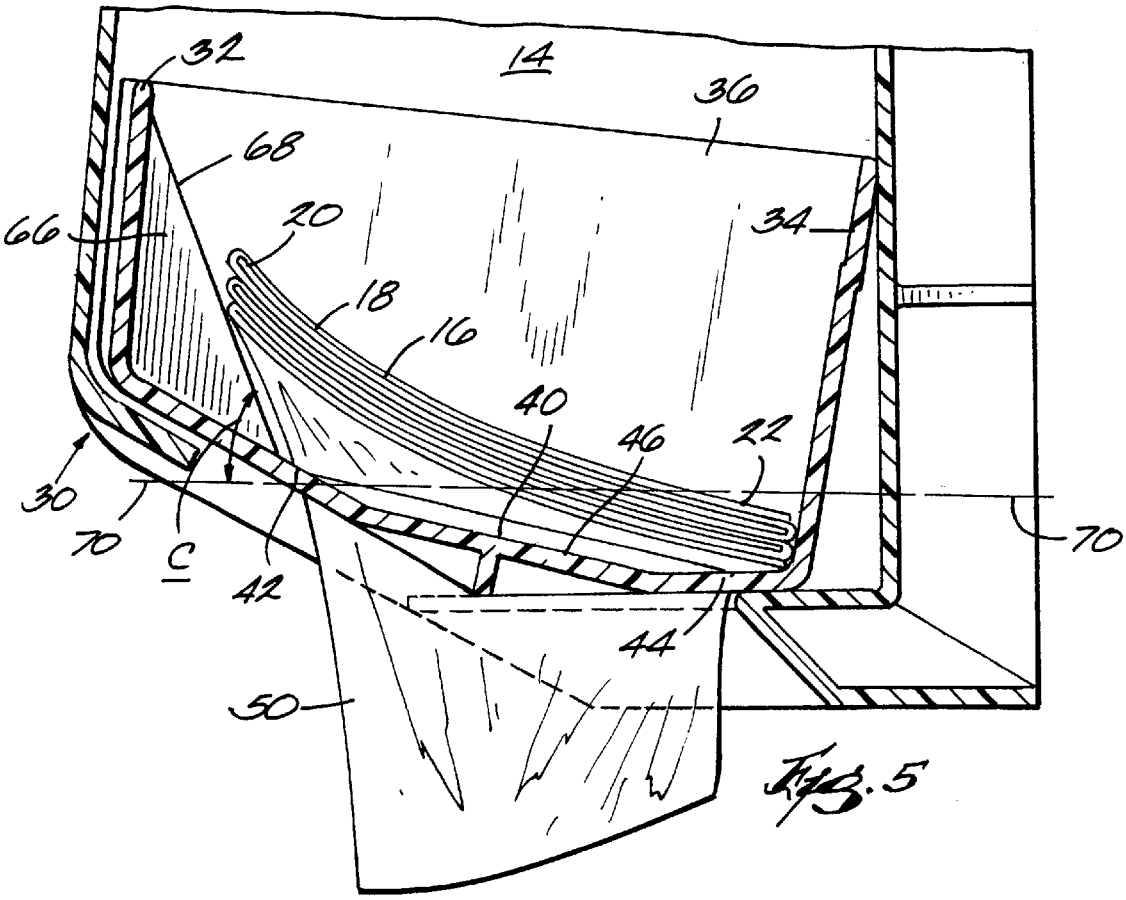
FIG. 5 is a fragmentary cross section view taken generally along line 5—5 in FIG. 2.
Figure 6:
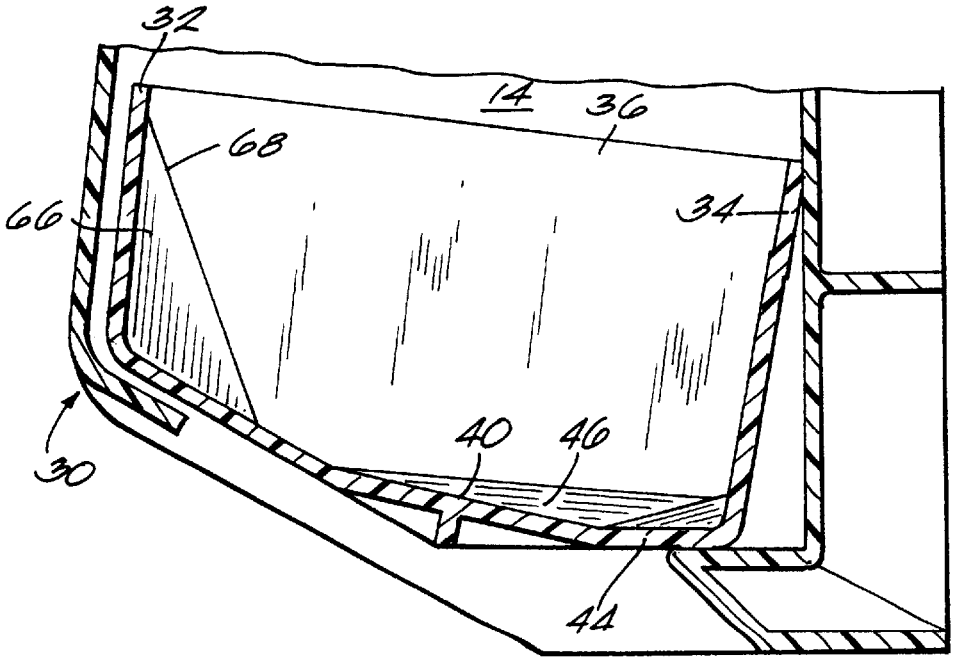
FIG. 6 is the same view as FIG. 5 but without paper towels present.

As best illustrated in FIG. 2, the lower portion 30 of the cabinet 12 preferably includes a front wall 32, a rear wall 34, opposed side walls 36 and a bottom wall 40. The bottom wall 40 has a front portion 42, a rear portion 44 and opposed side pads 46. Each opposed side pad 46 is preferably triangular in shape when viewed from above, with the base of the triangle coincident with an opposed side wall 36, and the apex of the triangle meeting the opening 52 adjacent to opposed end edge 58. Each opposed side pad 46 preferably slopes downwardly from its base to its apex.

Located in the bottom wall 40 is an elongated dispenser opening 52, having a length and width smaller than that of the paper towels 18, through which a fold 50 of the bottommost towel extends and is ready for a user to grab and pull the bottommost towel from the stack 16. The dispensing opening 52 has a front side edge 54, a rear side edge 56 and opposed end edges 58 spaced inwardly from respective side walls 36 of the lower portion 30. The front edge 54 preferably has a generally U-shape as illustrated in FIG. 2 for reasons explained in more detail below. Although the dispenser opening 52 is located in a rear portion of the bottom wall 40 in the illustrated preferred embodiment, it should be noted that the dispenser opening 52 can be in a more forward location if desired (preferably subject to the other features and elements of the present invention described in more detail below).

In accordance with the invention, the lower portion 30 of the cabinet 12 is arranged to reduce the force required for a user to pull the bottommost towel 18 from the stack 16 and yet permit the stack 16 to apply sufficient pressure on the next towel to prevent it from being pulled from the stack 16 along with the bottommost towel. In the specific embodiment illustrated, this is preferably accomplished in part by at least one of two methods.

First, pressure is reduced by providing one or more structural elements located in front of the front edge 54 of the opening 52 and extending upwardly from the front portion 42 of the bottom wall 40. This structure performs the function of transferring weight of the stack 16 from the front of the lower portion 30 of the cabinet 12 to the rear of the lower portion 30 of the cabinet, and preferably does so by elevating the front of the towels in the stack 16 with respect to the rear of these towels. Although the front of all towels in a stack 16 are preferably oriented in this manner as shown in FIGS. 1–6, similar results can be obtained by orienting at least the bottommost towels in this manner.

A number of different elements and structure can be used to perform the function just described. However, excellent results are obtained by employing a plurality of laterally spaced ribs or ramps 60, 62, 64, 66 located (as described above) in front of the front edge 54 of the opening 52 and extending upwardly from the front portion 42 of the bottom wall 40. Where such spaced ribs or ramps 60, 62, 64, 66 are employed, the inclined surfaces of these elements can be inclined toward or away from the front portion 42 of the bottom wall 40 (see ramps 60, 62, 64, 66 in the embodiment shown in FIGS. 1–6 and ramps 160, 162, 164 in the embodiment shown in FIGS. 7–10). In less preferred embodiments, the ribs can even be substantially vertical while still performing the same functions described above.

Referring again to the highly preferred embodiment of FIGS. 1–6, each of these ramps has an inclined surface 68 extending in a direction upwardly and away from the front edge 54 of the opening 52. That is, as viewed in FIGS. 3–5, the inclined surfaces 68 extend toward the front wall 32 at an acute angle relative to a horizontal plane 70 extending through the front edge 54 of the opening 52.

The front wall 32, the ribs 60, 62, 64, 66 (or other similar structure) and the front portion 42 are preferably integrally formed as shown in FIGS. 1–6. However, in alternative embodiments, the ribs 60, 62, 64, 66 can be integrally formed with just the front portion 42 or with just the front wall 32 as desired. Alternatively, the ribs 60, 62, 64, 66 can be separate elements attached to either or both of the front portion 42 and the front wall 32 in any conventional manner.

One side portion 20 of the bottommost towel 18 is supported on the inclined surfaces 68 of the ramps and the other side portion 22 rests on the rear portion 44 of the bottom wall 40 adjacent the rear wall 34. The ramps effectively transfer a portion of the pressure applied on the bottommost towel from the front side portion 20 to the rear side portion 22, thereby reducing the force required for a user to pull the bottommost towel 18 from the stack 16.

Although a plurality of spaced apart ribs or ramps 60, 62, 64, 66 are preferred for performing the pressure-transferring function described above, other elements can instead be used as desired. For example, the ribs or ramps 60, 62, 64, 66 can be replaced by one or more rotatable rollers upon an axle mounted in any conventional manner in front of the front edge 54 of the opening 52, by a plurality of posts, bosses, fingers, or other elements extending from the front portion 42 and/or front wall 32, by a bar, rod, tube, shaft, or other elongated element extending in front of the front edge 54 of the opening 52 across the interior of the cabinet 12, or even by a wall of the cabinet 12 that is shaped to project toward the stack 16 (e.g., the front wall 32 or the front portion 42 inwardly bent, angled, stepped, curved, bowed, or otherwise shaped to support or hold a stack in the same manner as the ribs or ramps 60, 62, 64, 66 described above). Each of these alternative elements and structures performs the same or similar functions to the ribs or ramps 60, 62, 64, 66, and falls within the spirit and scope of the present invention.

In some highly preferred embodiments of the present invention, the ramps 60, 62, 64, 66 (or alternative structures or elements as described above) are arranged to also transfer the pressure applied on the bottommost towel in a direction away from the center. Stated differently, the ramps 60, 62, 64, 66 impart curvature in the stack of towels between side portions 20 and 22 to relieve the stack weight pressure in the direction from side portion 20 to side portion 22. This is accomplished by progressively decreasing the acute angle of the inclined surfaces 68 in a direction away from the centrally located ramp 60. For example, in the specific embodiment illustrated in FIG. 3, the angle A of the inclined surfaces for the center ramp 60 and the two adjacent ramps 62 are the same and can be about 76.5°, the angle B of the inclined surfaces 68 for the ramps 64 are the same and can be about 75° and the angle C of the inclined surfaces 68 for the ramps 66 are the same and can be about 69.5°. The inclined surfaces 68 cause the side portion 20 of the towels 18 and the stack to assume an arcuate shape, i.e. a generally concave shape like that illustrated by the dashed line in FIG. 2.

Although the steepness of the ramps 60, 62, 64, 66 in the illustrated preferred embodiment gradually decreases with increased lateral distance away from the center of the cabinet 12, it should be noted that this feature of the present invention can be practiced by having as few as two surfaces defined by two ramps or other elements or structure (described above) in which the surface closest to the center of the cabinet 12 has a steeper angle than the surface farther away from the center of the cabinet 12. For example, where the front 20 of the stack 16 is supported on a surface of an inwardly-projecting front wall 32 (rather than upon ribs), the front wall 32 can be steeper near the center of the stack 16 than at the ends 24 of the stack 16 to produce the same stack shape as the differently-angled ribs 60, 62, 64, 66 described above. Similarly, any of the elements and structures referred to earlier as alternatives to ribs 60, 62, 64, 66 can be shaped in such a manner and fall within the spirit and scope of the present invention.

Most preferably, the ribs 60, 62, 64, 66 have varying steepnesses as described above. However, the ribs 60, 62, 64, 66 (or alternative elements and structure thereto) in less preferred embodiments can present the same angle to the stack 16 across the length of the stack 16, if desired. In other words, the ribs 60, 62, 64, 66 can each have generally the same angle.

A second method used to reduce the force required for a user to pull the bottommost towel 18 from the stack 16 and yet permit the stack 16 to apply sufficient pressure on the next towel to prevent it from being pulled from the stack 16 along with the bottommost towel employs the opposed side pads 46. Stated differently, the pads 46 impart curvature in the stack of towels between opposed end portions 24 to relieve the stack weight pressure in the direction between the end portions 24. In the illustrated preferred embodiment of FIGS. 1–6, the pads 46 are triangular in shape, and slope downwardly toward the opening 52. The downward slope of the triangular shape of each opposed side pad 46 transfers the pressure applied on the bottommost towel in a direction away from opposed end portions 24 of the towel and toward the opening 52. The inclined opposed side pads 46 cause the opposed end portions 24 of the towels 18 and the stack to assume an arcuate shape, i.e., a generally upwardly-directed concave shape. The opposed side pads 46 prevent a towel 18 from hanging up when being pulled from the stack 16. Although triangular side pads 46 are preferred, the side pads 46 can take virtually any shape desired, including without limitation square, rectangular, round, oval, and the like. As with triangular side pads 46, these other pads act to funnel the opposed end portions 24 of the towels 18 toward the opening 52.

In addition to or instead of employing a wall structure to define the pads 46 as illustrated in FIGS. 1–6, one or more projections can extend from the bottom wall 40 and/or side walls 36 of the cabinet 12, upon which the end portions 24 of the stack 16 rest in a manner similar to that just described with reference to the pads 46. These projections can be in the form of spaced ribs or ramps such as those at the front of the cabinet, or can take any of the alternative forms of such ribs or ramps described above.

A third method used to reduce the force required for a user to pull the bottommost towel 18 from the stack 16 and yet permit the stack 16 to apply sufficient pressure on the next towel to prevent it from being pulled from the stack 16 along with the bottommost towel employs the shape of the bottom portion 30. This method is described in detail below with respect to the embodiment of the present invention shown in FIGS. 7–10, but can be also applied to the first preferred embodiment.

In operation, a user pulls the exposed towel from the opening 52. Because the folds of the towels are preferably intertwined, the flap or fold of the next towel to be distributed is pulled down through the opening 52. Because of the curvature imparted to the stack of towels by both the ramps 60, 62, 64, 66, and the pads 46, the fibers of the flap of the paper towel are preferably actually broken, causing the flap of the next towel to be distributed to retain a C-like shape. Moreover, the opening 52 is arranged to cause the flap 50 of the towel 18 next to the bottommost one to be "puffed", i.e. formed into a C-like shape as illustrated in FIGS. 1 and 2, as the bottommost towel is pulled from the stack. This encourages a user to grab the center of the flap 50 and pull from the center of the stack where the least pressure is applied. In the specific embodiment illustrated, this is accomplished by arranging the front edge 54 of the opening 52 to have a generally U-shape and providing the rear edge 56 of the opening 52 with opposite end portions 72 and 74 connected to the rear edge 56 and extending at an angle outwardly toward the opposite end edges 58 and in the direction of a respective side wall 36.

Figure 9:
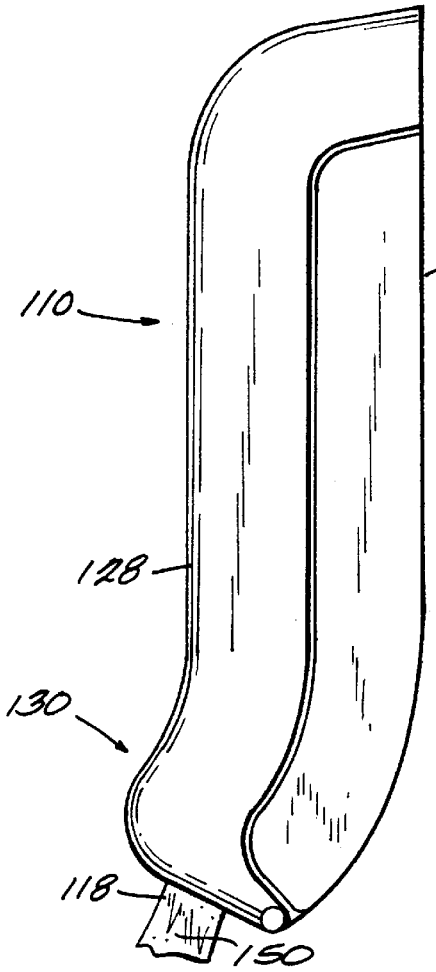
FIG. 9 is an elevation side view of the embodiment illustrated in FIG. 7.
Figure 10:
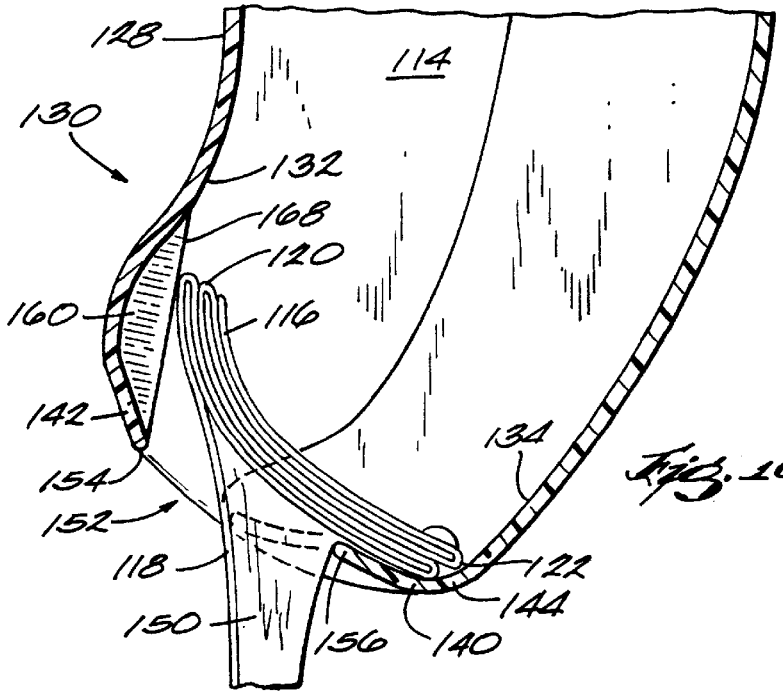
FIG. 10 is a fragmentary cross section view taken generally along line 10—10 in FIG. 7.

FIGS. 7–10 illustrate an alternate embodiment of the dispenser 10 described above. As best illustrated in FIGS. 9 and 10, a dispenser 110 for folded paper towels incorporates various features of the invention. The dispenser 110 includes a housing or cabinet 112 having an internal chamber 114 for holding a generally vertically oriented stack 116 of elongated, generally rectangular folded paper towels 118 having opposed side portions 120 and 122 and opposed end portions 124. The paper towels 118 are preferably multi-folded, and can be Z-folded paper towels in which succeeding towels are interfolded, C-folded paper towels in which succeeding towels are merely stacked, or any other towels folded or interfolded in any conventional manner. The cabinet 112 preferably has a pivotally mounted front door 128 which can be swung down to gain access to the chamber 114 and a lower portion 130 from which individual paper towels 118 can be dispensed from the stack 116.

As best illustrated in FIGS. 8 and 10, the lower portion 130 of the cabinet 112 preferably includes a front wall 132, a rear wall 134, opposed side walls 136 and a bottom wall 140. The bottom wall 140 has a front portion 142, a rear portion 144 and opposed side pads 146. Each opposed side pad 146 is preferably triangular in shape when viewed from above, with the base of the triangle coincident with an opposed side wall 136, and the apex of the triangle meeting the opening 152 adjacent to opposed end edge 158. Each opposed side pad 146 slopes downwardly from its base to its apex. In alternative embodiments, the side pads 146 can take any shape as described above with reference to the first preferred embodiment of the present invention, and can also or instead include any number of inwardly-projecting surfaces for supporting the stack ends 124 as also described above. The opposed side pads 146 and such inwardly-projecting surfaces (if used) perform the same functions as those of the first preferred embodiment above.

Located in the bottom wall 140 is an elongated dispenser opening 152, having a length and width smaller than that of the paper towels 118, through which a fold 150 of the bottommost towel extends and is ready for a user to grab and pull the bottommost towel from the stack 116. The elongated dispenser opening 152 can be located differently in the bottom wall 140 as described above with reference to the first preferred embodiment. The dispensing opening 152 has a front side edge 154, a rear side edge 156 and opposed end edges 158 spaced inwardly from respective of the side wall 136. The front edge 154 preferably has a generally U-shape as illustrated in FIG. 7 for reasons explained in more detail below.

In accordance with the invention, the lower portion 130 of the cabinet 112 is arranged to reduce the force required for a user to pull the bottommost towel 118 from the stack 116 and yet permit the stack 116 to apply sufficient pressure on the next towel to prevent it from being pulled from the stack 116 along with the bottommost towel. In the specific embodiment illustrated, this is preferably accomplished in part by at least one of three methods.

First, pressure is reduced by providing a plurality of laterally spaced ribs or ramps 160, 162, 164 (see FIG. 8) located on the front wall 132 adjacent the front edge 154 of the opening 152 and extending outwardly from the curved front wall 132 (see FIG. 10). Each of these ramps has an inclined surface 168 extending in a generally upward direction. The ramps 160, 162, 164, their function, and alternative devices and structures to the ramps 160, 162, 164 are similar to those of the first preferred embodiment described above, with the exception that the ramps 160, 162, 164 (or alternative devices and structures) are preferably located on the back side of the door 128 as shown in FIGS. 8 and 10.

One side portion 120 of the bottommost towel 118 is supported on the inclined surfaces 168 of the ramps 160, 162, 164 and the other side portion 122 rests on the rear portion 144 of the bottom wall 140 adjacent the rear wall 134 (see FIG. 10). The ramps effectively transfer a portion of the pressure applied on the bottommost towel from the side portion 120 to the other side portion 122, thereby reducing the force required for a user to pull the bottommost towel 118 from the stack 116.

Like the ramps 60, 62, 64, 66 of the first preferred embodiment, the ramps 160, 162, 164 (or alternative structures and device thereto) can have a varying or constant steepness along the length of the stack 116.

A second method used to reduce the force required for a user to pull the bottommost towel 118 from the stack 116 and yet permit the stack 116 to apply sufficient pressure on the next towel to prevent it from being pulled from the stack 116 along with the bottommost towel employs opposed side pads 146 (see FIG. 8). Stated differently, the pads 146 impart curvature in the stack of towels between opposed end portions 124 to relieve the stack weight pressure in the direction between the end portions 124. The downward slope of each opposed side pad 146, as illustrated in FIG. 8, transfers the pressure applied on the bottommost towel in a direction away from opposed end portions 124 of the towel and toward the opening 152. The inclined opposed side pads 146 cause the opposed end portions 124 of the towels 118 and the stack to assume an arcuate shape, i.e., a generally upwardly-directed concave shape. The opposed side pads 146 prevent a towel 118 from hanging up when being pulled from the stack 116. As stated above, in alternate embodiments, the side pads 146 can be of any shape desired, and preferably are triangularly shaped as illustrated in FIG. 8. Additional information regarding the side pads 146, their function, and alternatives thereto can be found in the description of the first preferred embodiment above.

A third method used to reduce the force required for a user to pull the bottommost towel 118 from the stack 116 and yet permit the stack 116 to apply sufficient pressure on the next towel to prevent it from being pulled from the stack 116 along with the bottommost towel employs a unique shape of the bottom portion 130 of the cabinet 112. As illustrated in FIGS. 9 and 10, the bottom portion 130 of the cabinet 112 is angled away from the remainder of the cabinet 112 (which is generally vertical). As a result, a majority of the weight of stack 116 is directed away from the bottommost of the towels 118 and toward the curved rear wall 134. Stated differently, the outward angle of the bottom portion 130 transfers the pressure applied on the bottommost towel in a direction away from the side portion 120 to and beyond the other side portion 122, thereby reducing the force required for a user to pull the bottommost towel 118 from the stack 116. The outward angle of the bottom portion 130 can be defined by curved cabinet walls 132, 134, 136 as shown in FIGS. 7–10 or can be defined by cabinet walls 132, 134, 136 that have multiple portions angled with respect to one another to orient the bottom portion 130 at an angle with respect to the remainder of the cabinet 112.

The use of a bottom portion 130 outwardly angled with respect to the remainder of the cabinet 112 is a preferred feature of the present invention that can be used alone or in conjunction with the other features and elements of the present invention described above, such as with ramps 160, 162, 164, with opposed side pads 146, and the like.

In an example of operation, a user pulls the exposed towel from the opening 152. Because the folds of the towels are intertwined in the case of interfolded towels (e.g., Z-interfolded towels), the flap or fold of the next towel to be distributed is pulled down through the opening 152. Because of the curvature imparted to the stack of towels by both the ramps 160, 162, and 164, and the pads 146, the fibers of the flap of the paper towel are preferably actually broken, causing the flap of the next towel to be distributed to retain a C-like shape. Moreover, the opening 152 is preferably arranged to cause the flap 150 of the towel 118 next to the bottommost one to be "puffed", i.e. formed into a C-like shape generally shown in FIG. 7, as the bottommost towel is pulled from the stack. This encourages a user to grab the center of the flap 150 and pull from the center of the stack where the least pressure is applied. In the specific embodiment illustrated, this is accomplished by arranging the front edge 154 of the opening 152 to have a generally U-shape and providing the rear edge 156 of the opening 152 with opposite end portions 172 and 174 connected to the rear edge 156 and extending at an angle outwardly toward the opposite end edges 158 and in the direction of a respective side wall 136.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, in both illustrated preferred embodiments of the present invention, the front portion 20, 120 of the stack 16, 116 is located upon or against ribs 60, 62, 64, 66, 160, 162, 164 while the rear portion 22, 122 of the stack 16, 116 is located upon or against a rear portion 44, 144 of the bottom wall 40, 140. In alternative embodiments, the ribs or other alternative devices or structures thereto can be located at a rear portion of the cabinet 12, 112 while the stack 16, 116 can be supported against a surface of the bottom wall 40, 140 located at the front of the cabinet 12, 112. Such a bottom portion arrangement is essentially the opposite of that illustrated in the figures, but would perform similar functions to those described above. Similarly, less preferred embodiments of the present invention can have bottom portions 130 angled rearwardly rather than forwardly as described above and illustrated in FIGS. 7–10.

We claim:

1. A device for dispensing paper towels having opposed, longitudinally extending side portions and opposed end portions, said device comprising:

a housing defining a chamber for holding a generally vertical stack of the paper towels and including a lower portion having a bottom wall having a front portion, a rear portion, opposed side portions, and opposed end portions;

an opening through which individual towels can be dispensed, the opening having front, rear, and side edges; and a plurality of laterally spaced ribs located adjacent one of said front and rear edges of said opening, each of said ribs having an inclined surface extending at an angle upwardly from said opening and adapted to be engaged by and support one side portion of the stack of paper towels with the other side portion of the paper towels supported on the other of the front and rear portions of said bottom wall and thereby transfer a portion of the pressure applied by the stack on a bottommost towel of the stack from the side portion supported on said ribs toward the other side portion;

wherein the end portions of the bottom wall are at least partially defined by pads angled downwardly toward said opening.

2. A device according to claim 1, wherein the inclined surfaces extend at an angle upwardly and away from the first side edge of said opening.

3. A device according to claim 1, wherein the housing defines a generally vertical plane, and wherein the lower portion extends from the housing at an angle to the plane.

4. A device according to claim 1, further comprising a door on the housing, wherein the ribs extend from the door.

5. A device according to claim 1, wherein:

the housing has a front wall; and the ribs are integrally formed with the front wall.

6. A device according to claim 1, wherein the housing includes a front shell and a rear shell, and wherein the front shell is hingedly attached to the rear shell.

7. A device according to claim 1, wherein one of said front and rear edges of said opening is generally U-shaped.

8. A device according to claim 7, wherein the other of said front and rear edges of said opening has a laterally extending central portion and end portions connected to respective ends of said central portion which extend at an angle inwardly toward said one of said front and rear edges and outwardly toward respective side walls of said bottom portion and cause a fold of the bottommost towel extending through said opening to assume a C-like shape.

9. A device for dispensing paper towels having opposed, longitudinally extending side portions and opposed end portions, said device comprising:

a housing defining a chamber for holding a generally vertical stack of the paper towels and including a lower portion having a bottom wall having opposed side portions; and an opening between the opposed side portions through which individual towels can be dispensed;

at least one of the end portions of the bottom wall at least partially defined by a pad angled downwardly toward the opening and adapted to be engaged by and support one end portion of the stack of paper towels and thereby transfer a portion of the pressure applied by the stack on a bottommost towel of the stack from the end portion supported on said pad toward said opening;

wherein the opening has front and rear edges between the opposed side portions of the bottom wall, the device further comprising a plurality of laterally spaced ribs located adjacent one of said front and rear edges of said opening, each of said ribs having an inclined surface extending at an angle upwardly from said opening and adapted to be engaged by and support one side portion of the stack of paper towels.

10. A device according to claim 9, wherein the bottom wall has front and rear portions adjacent to the front and rear edges of said opening, and wherein the other of the front and rear portions of the bottom wall is adapted to support the other side portion of the paper towels to thereby transfer a portion of the pressure applied by the stack on the bottommost towel of the stack from the side portion supported on said ribs toward the other side portion.

11. A device according to claim 9, wherein the housing defines a generally vertical plane, and wherein the lower portion extends from the housing at an angle to the plane.

12. A device according to claim 9, further comprising a door on the housing, wherein the ribs extend from the door.

13. A device according to claim 9, wherein:

the housing has a front wall; and the ribs are integrally formed with the front wall.

14. A device according to claim 9, wherein the housing includes a front shell and a rear shell, and wherein the front shell is hingedly attached to the rear shell.

15. A device according to claim 9, wherein the opening has front and rear edges, one of said front and rear edges of said opening being generally U-shaped.

16. A device according to claim 15, wherein the other of said front and rear edges of said opening has a laterally extending central portion and end portions connected to respective ends of said central portion which extend at an angle inwardly toward said one of said front and rear edges and outwardly toward respective side walls of said bottom portion and cause a fold of the bottommost towel extending through said opening to assume a C-like shape.

17. A device according to claim 9, wherein the opening has a central portion, the angles of the inclined surfaces decreasing in steepness with increased distance from the central portion of said opening to cause the side portions of the towels supported on said ribs to assume an arcuate configuration and to distribute pressure applied by the stack on the bottommost towel in opposite directions away from the central portion of said opening.

18. A device for dispensing paper towels having opposed, longitudinally extending side portions and opposed end portions, said device comprising:

a housing defining a chamber for holding a generally vertical stack of the paper towels and including a lower portion through which individual towels can be dispensed from the stack, and an upper portion, said lower portion including a front wall, rear wall, opposed side walls and a bottom wall having a front portion, a rear portion, and opposed side portions;

an elongated opening smaller than the paper towels in said bottom wall and through which individual towels can be dispensed, the elongated opening having front and rear edges between the opposed side portions of the bottom wall; and a plurality of laterally spaced ribs located adjacent one of the front and rear edges of said opening, each of said ribs having an inclined surface extending at an angle upwardly from said opening and adapted to be engaged by and support one side portion of the stack of paper towels;

the housing shaped to define a straight upper portion of the chamber and a lower portion of the chamber disposed at an angle with respect to the upper portion of the chamber.

19. A device according to claim 18, wherein one of the front and rear portions of the bottom wall is adapted to support the other side portion of the paper towels to thereby transfer a portion of the pressure applied by the stack on a bottommost towel of the stack from the side portion supported on said ribs toward the other side portion.

20. A device according to claim 18, further comprising a door on the housing, wherein the ribs extend from the door.

21. A device according to claim 18, wherein:

the housing has a front wall; and the ribs are integrally formed with the front wall.

22. A device for dispensing paper towels having opposed, longitudinally extending side portions and opposed end portions, said device comprising:

a housing defining a chamber for holding a generally vertical stack of the paper towels and including a lower portion through which individual towels can be dispensed from the stack, and an upper portion, said lower portion including a front wall, rear wall, opposed side walls and a bottom wall having a front portion, a rear portion, and opposed side portions; and an elongated opening smaller than the paper towels in said bottom wall and through which individual towels can be dispensed;

the housing shaped to define a straight upper portion of the chamber and a lower portion of the chamber disposed at an angle with respect to the upper portion of the chamber, wherein the side portions of the bottom wall are at least partially defined by pads angled downwardly toward said opening.

23. A device for dispensing generally rectangular paper towels having opposed, longitudinally extending side portions, said device comprising:

a housing defining a chamber for holding a generally vertical stack of the paper towels and including a lower portion having an opening through which individual towels can be dispensed from the stack, said lower portion including a plurality of laterally spaced ribs located in the vicinity of said opening, each of said ribs having an inclined surface extending at an angle upwardly and in a direction away from said opening and adapted to be engaged by and support one side portion of the stack of paper towels and thereby transfer a portion of the pressure applied by the stack on the bottommost towel from the side portion supported on said ribs toward the other side portion, and end portions on opposite ends of the opening and at least partially defined by pads angled downwardly toward said opening.

24. A method for dispensing generally rectangular paper towels having opposed, longitudinally extending side portions, and opposed end portions, said method including:

receiving a generally vertical stack of the paper towels within a housing;

supporting one side portion of the stack of paper towels at a first elevation;

supporting an opposite side portion of the stack of paper towels at a second elevation lower than the first elevation;

imparting a curve to the stack between the side portions thereof to transfer a portion of pressure applied by the stack on a bottommost towel from the one side portion toward the opposite side portion; and imparting a second curve to the stack between the end portions of the stack.

25. A method according to claim 24, wherein supporting one side portion includes supporting the one side portion upon a plurality of laterally spaced ribs each having an upwardly inclined surface in contact with the stack.

26. A method according to claim 24, further comprising imparting a second curve to the stack by supporting the one side portion of the stack at different elevations longitudinally along the stack.

27. A method according to claim 24, further comprising tilting the stack in the housing at a bottom portion of the housing to transfer a portion of the pressure applied by the stack on the bottommost towel from one side portion toward the other side portion.

28. A method for dispensing generally rectangular paper towels having opposed side portions, said method including:

receiving a generally vertical stack of the paper towels within a housing having a straight upper portion and a lower portion disposed at an angle with respect to the straight upper portion and through which individual towels can be dispensed from the stack; and tilting the stack via the lower portion of the housing to transfer a portion of the pressure applied by the stack on a bottommost towel thereof from one side portion toward the other side portion; and supporting one side of the stack upon a plurality of laterally spaced ribs each having an upwardly inclined surface in contact with the stack.

29. A method according to claim 28, further comprising imparting a curve to the stack by supporting the one side of the stack at a higher elevation than the opposite side of the stack.

30. A method according to claim 29, further comprising imparting a second curve to the stack by supporting the one side portion of the stack at different elevations longitudinally along the stack.

* * * * *